United States Patent [19]

Middlebrook et al.

[11] 3,990,496

[45] Nov. 9, 1976

[54] APPARATUS FOR HANDLING COMPACTED COMPOST, SOIL AND THE LIKE

[75] Inventors: Paul James Middlebrook, Selby; Bernard Paul Grace, Leeds; Peter Woodward, Wakefield, all of England

[73] Assignee: Monomech Developments Limited, Pontefract, England

[22] Filed: Sept. 12, 1974

[21] Appl. No.: 505,280

[30] Foreign Application Priority Data

Sept. 22, 1973 United Kingdom ..... 44566/73

[52] U.S. Cl. ..... 100/215; 100/218; 100/223; 100/229 R; 100/246; 214/16.4 R; 425/438; 425/455 R

[51] Int. Cl.[2] ..... B30B 15/30; B30B 15/32

[58] Field of Search ..... 425/422, 438, 441, 453, 425/455; 214/82, 16.4 R, 6 DK; 100/215, 218, 221, 223, 246, 229 R

[56] References Cited

UNITED STATES PATENTS

| | | | |
|---|---|---|---|
| 601,138 | 3/1898 | Hall | 100/223 X |
| 3,103,729 | 9/1963 | Flamand | 425/422 X |
| 3,343,689 | 9/1967 | Fehely | 214/6 DK |
| 3,389,652 | 6/1968 | Bruder et al. | 214/16.4 R |

*Primary Examiner*—Billy J. Wilhite

*Attorney, Agent, or Firm*—Harrington A. Lackey

[57] ABSTRACT

An apparatus for handling compacted blocks of compost, soil or the like material comprising a chamber defined by two relatively movable plates in which a batch of material is compacted at a compacting station. The chamber is moved to a depositing station at which the block is removed by firstly retracting one of the plates while the other plate holds the block, and then by retracting the other plate, leaving the block deposited on a platform. The apparatus desirably is in the form of a wheel assembly having plates defining a number of chambers radiating from the wheel axis and there is means for indexing the wheel so that each chamber moves in turn from the compacting station to the depositing station.

14 Claims, 19 Drawing Figures

34
36
22
30
12
28
10
32
4

44
174
16
30
22
38
42
40

114
112
110
108
104
102
100
98
106
18
20
166
164
122
H
H
140
162
160

APPARATUS FOR HANDLING COMPACTED COMPOST, SOIL AND THE LIKE

This invention relates to apparatus for handling blocks of compacted compost, soil and the like.

In the growing of mushrooms and other horticultural produce, it is known to stack blocks of compacted compost on platforms on a rack, sometimes in trays, and in which the mushrooms are allowed to grow. They subsequently are picked by hand.

In one known method of filling the racks with the compost blocks, the rack is turned on its side and the individual tiers are filled with compost from an overhead elevator. The compost subsequently is compacted by an overhead tamping means. The rack is moved horizontally between filling of tiers to enable the tiers to be filled and compacted individually.

This method generally is unsatisfactory because the rack must subsequently be turned to an upright position when filled and the compacted soil or compost thereby can be disturbed and/or spilled, and the compacted blocks tend to loose their compacted shape and their homogenity. This makes for different growing conditions within the blocks and hence variation within the final produce when fully grown.

Furthermore the rack, and trays and platforms must be of robust construction as otherwise they may tend to fracture during the compaction processes.

The present invention aims to obviate or mitigate the disadvantages of the known method as outlined above.

According to the present invention, there is provided apparatus for the handling of blocks of compacted soil, compost or the like, including means defining a chamber adapted to be held at a receiving station to receive a batch of soil, compost or the like so that the material can be compacted by a compaction means, means for moving the means difining the chamber to a discharge station, means for moving the means defining the chamber whilst at said discharge station onto a platform, said means defining the chamber being such that it can be retracted leaving a compacted block of compost, soil or the like on the platform.

Preferably, the apparatus includes a plurality of means each defining a chamber and adapted to move in an endless path so as to be capable of being positioned in turn to receive a batch of material and then be moved to the discharge station, and said means for moving the means defining the chamber is adapted to co-operate with and operate each means defining a chamber in turn whilst each means defining a chamber is at the discharge station.

Preferably, the or each means defining a chamber is adapted to be moved and retracted by said means in a horizontal direction, whilst at said discharge station.

The means defining the or each chamber may comprise a base plate and a top plate which are independently movable and which lie horizontally whilst at the discharge station. The top plate has an integral end plate against which a batch of material in the chamber can be compacted. The base plate and top plate whilst at the discharge station, are movable as a unit to the receiving platform but the plate is adapted to be retracted before the top plate to enable the compacted block to sit onto the platform before the top plate is retracted, leaving the block on the platform.

The means defining the chambers preferably are arranged radially, at equal intervals, on a wheel assembly rotatable about a horizontal axis. There may be four means each defining a chamber. An embodiment of the present invention will now be described, by way of example, with reference to the accompanying drawings, wherein.

Figure 1:
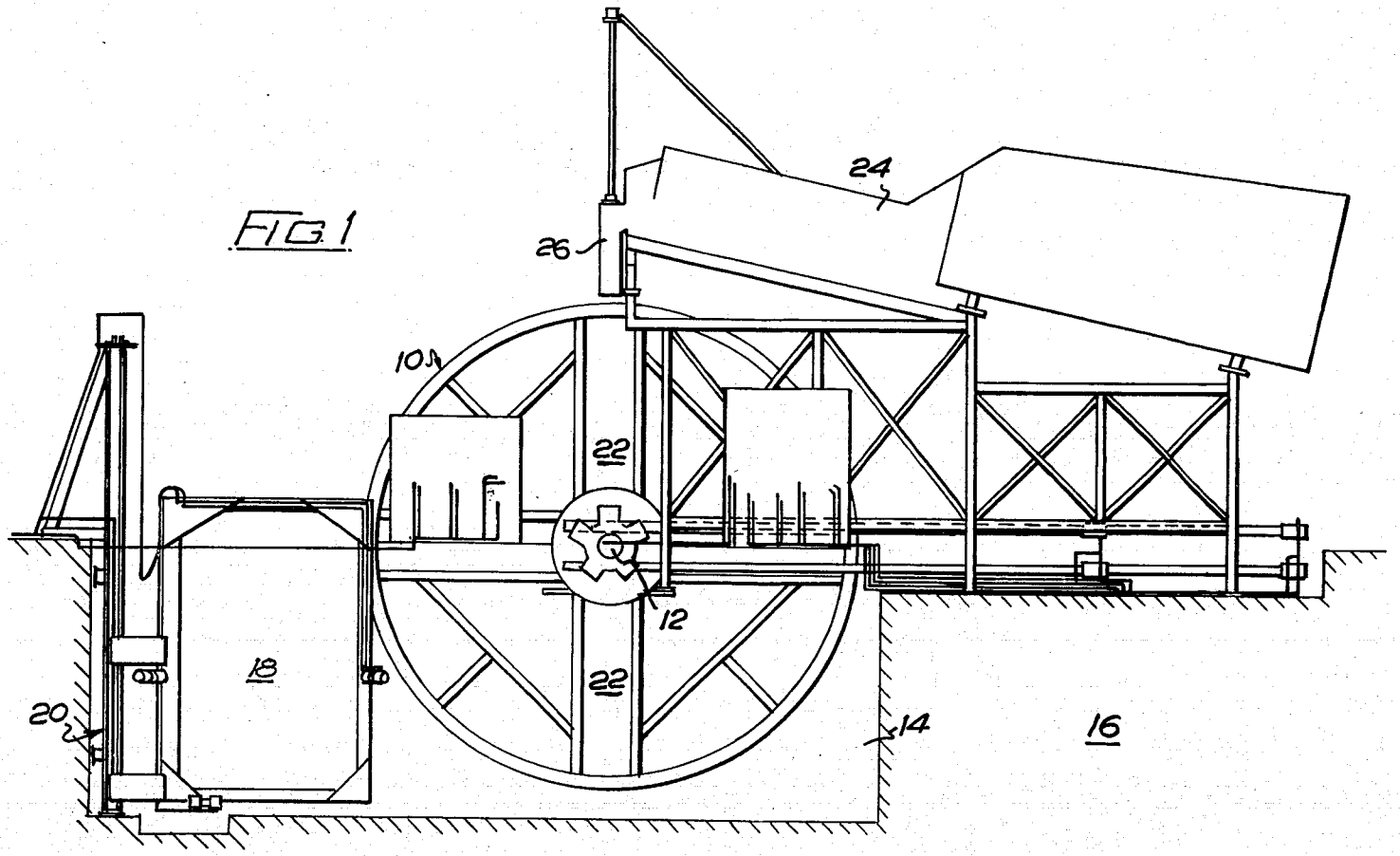
FIG. 1 is a side view of apparatus according to the invention.
Figure 2:
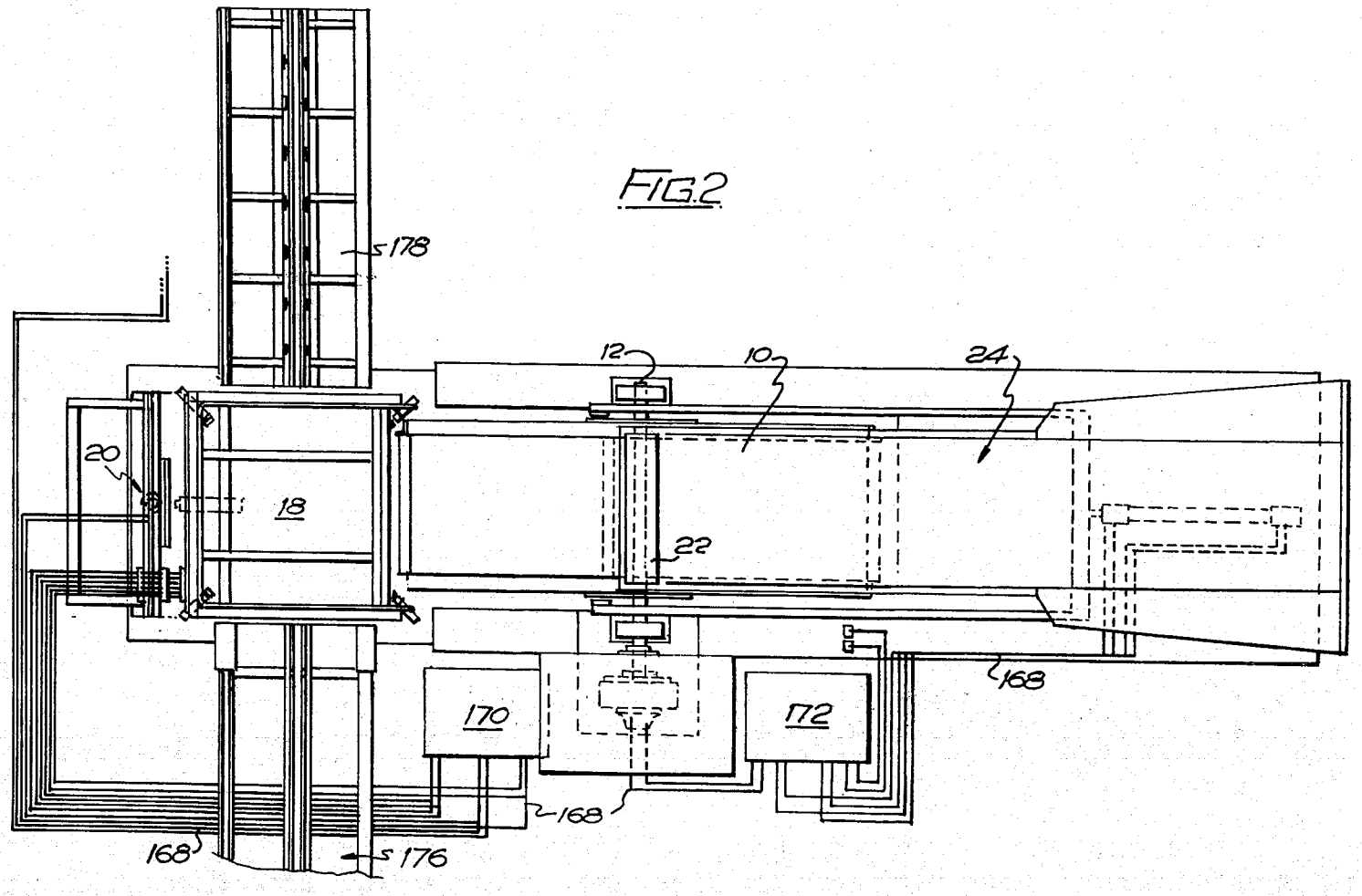
FIG. 2 is a plan view of the apparatus shown in FIG. 1.
Figure 14:
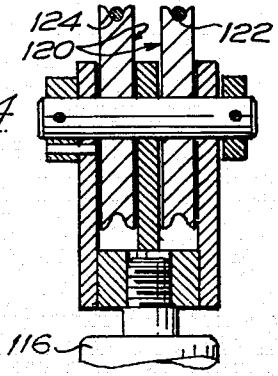
Figure 13:
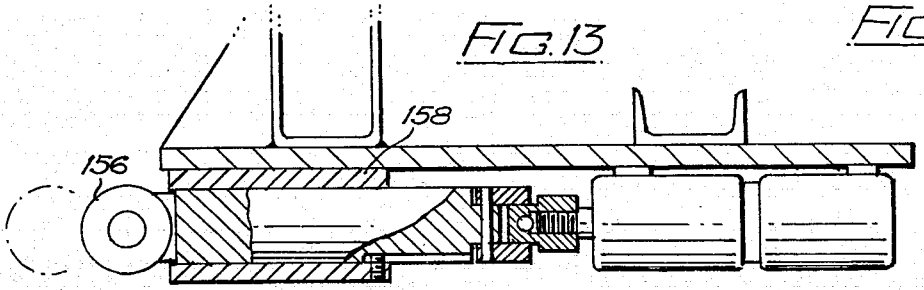
Figure 16:
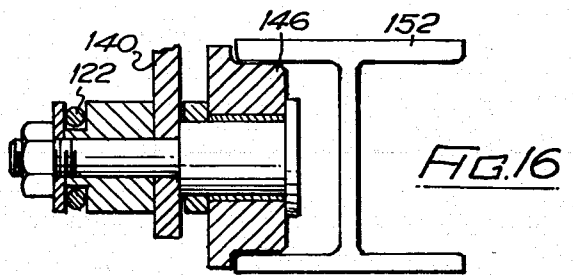
Figure 15:
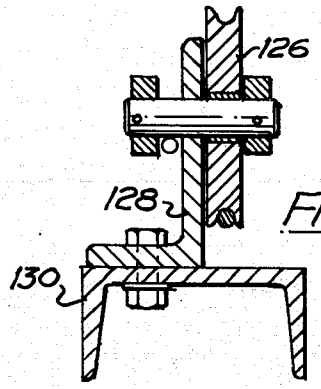
Figures 7, 8:
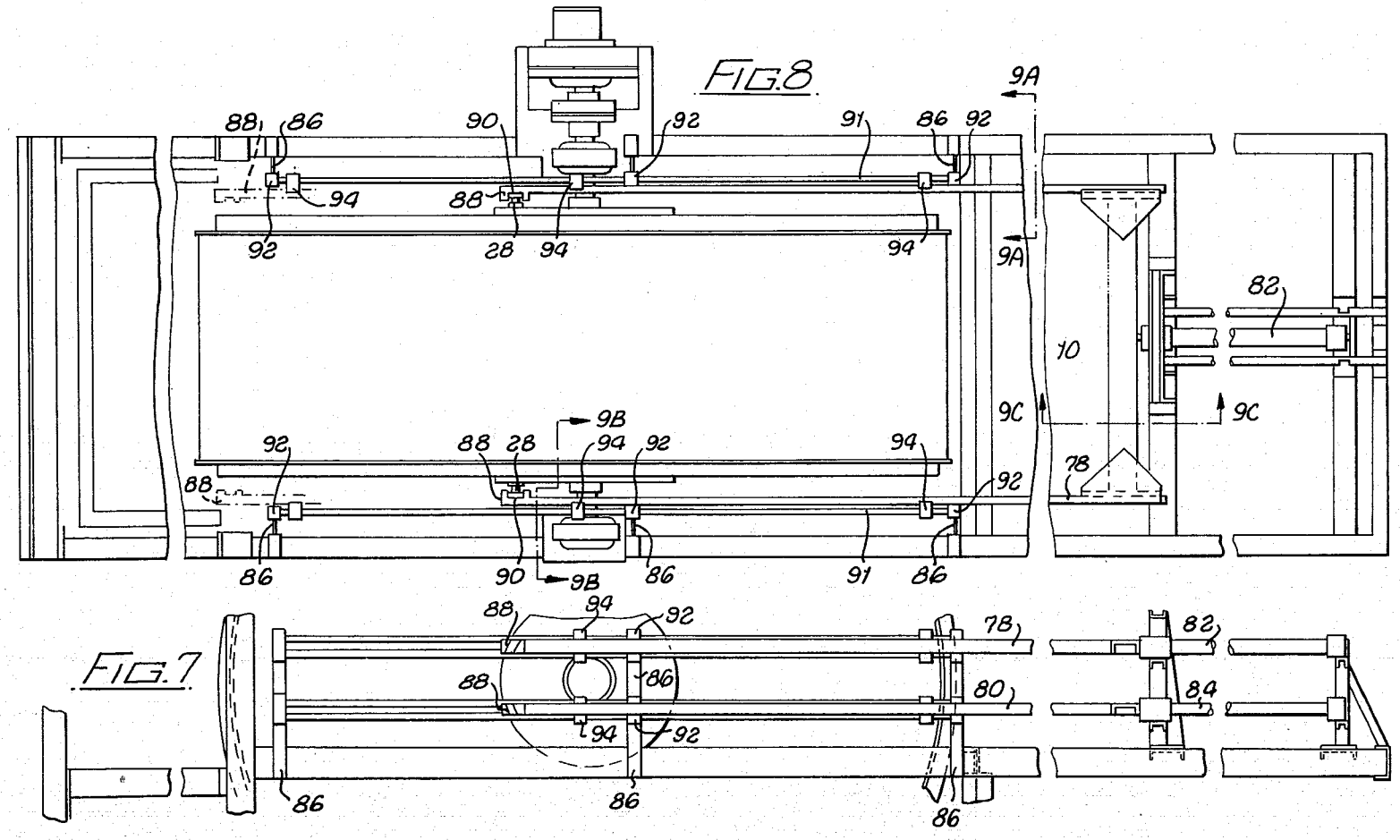
FIG. 7 is a side view of an ejection means of the apparatus of FIGS. 1 and 2, for ejecting blocks of compost from the wheel assembly of FIG. 3.
FIG. 8 is a plan view of the ejection means shown in FIG. 7.
Figure 9A:
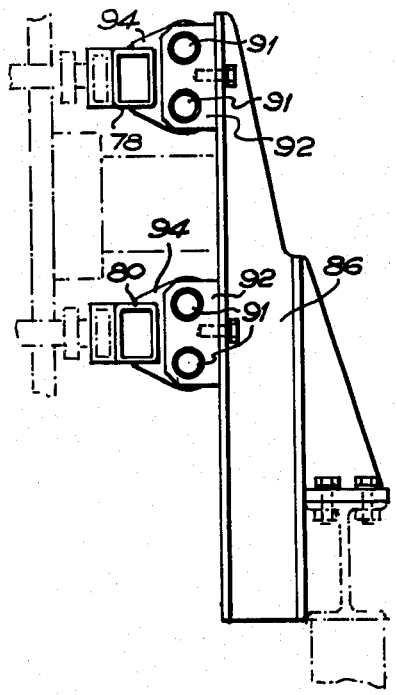
Figure 9B:
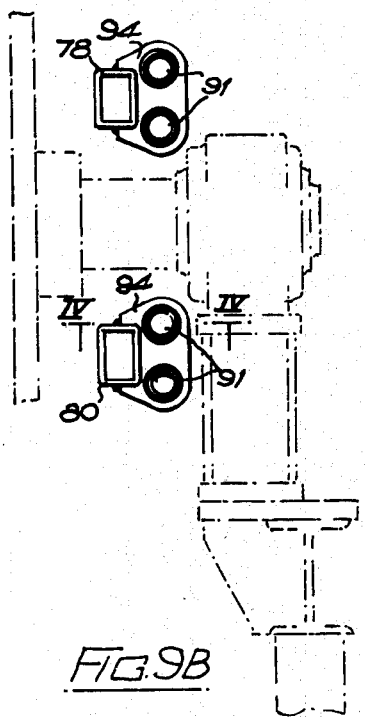
Figure 9C:
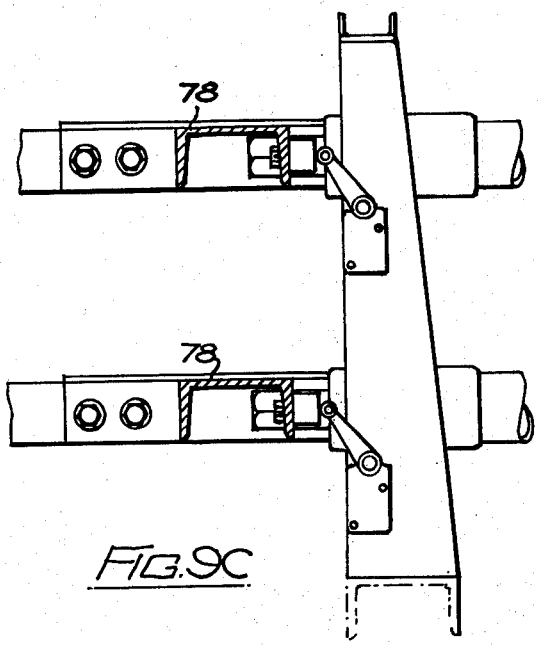
Figure 9D:
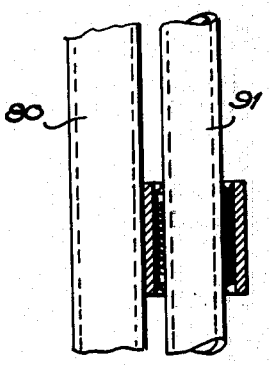
Figure 10:
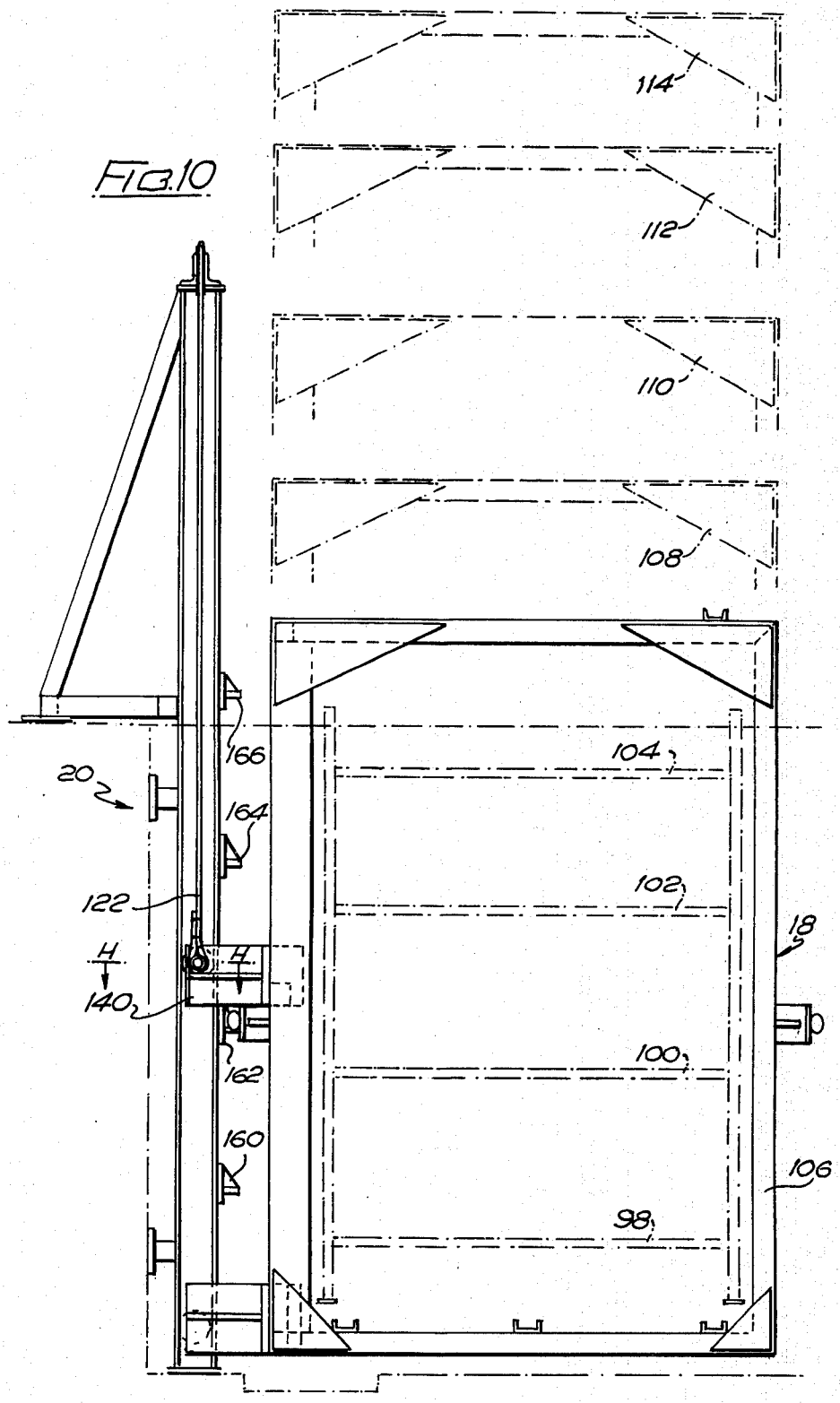
Figure 11:
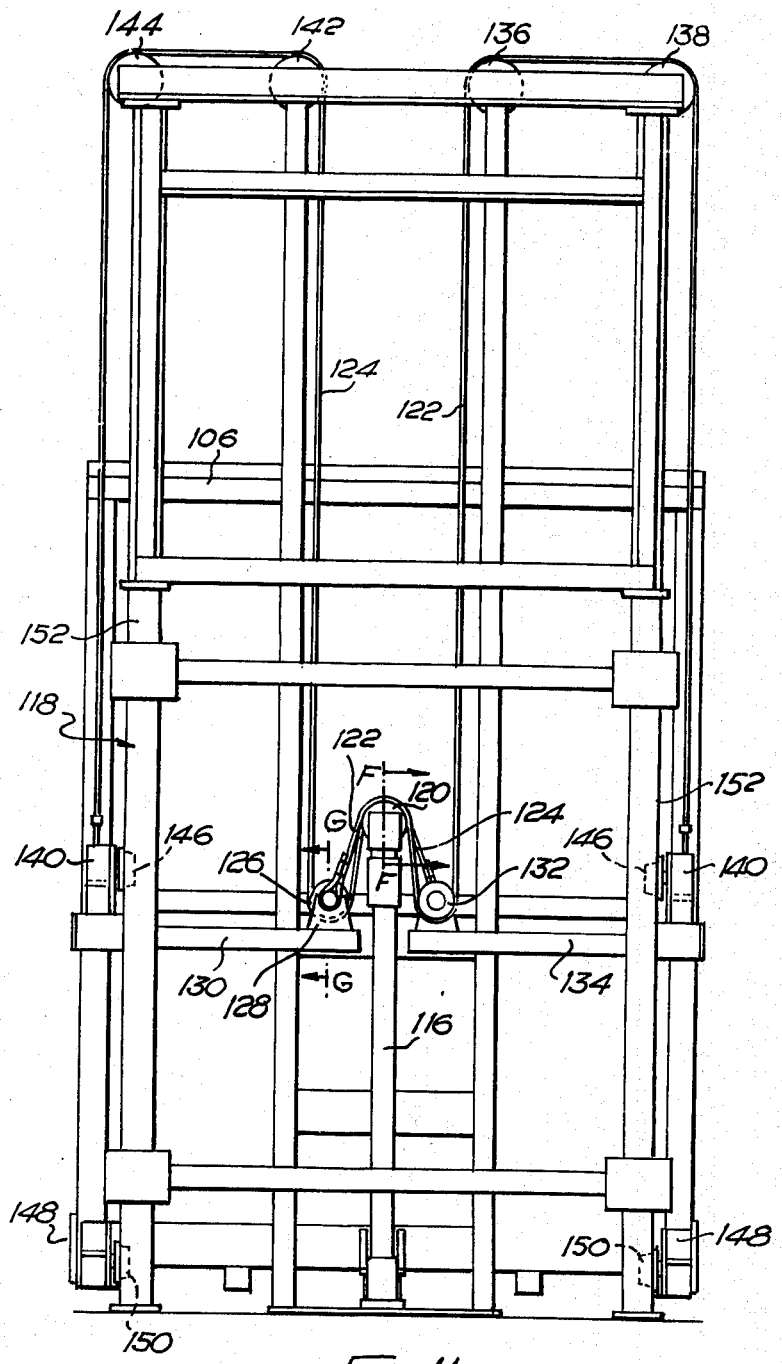
Figure 12:
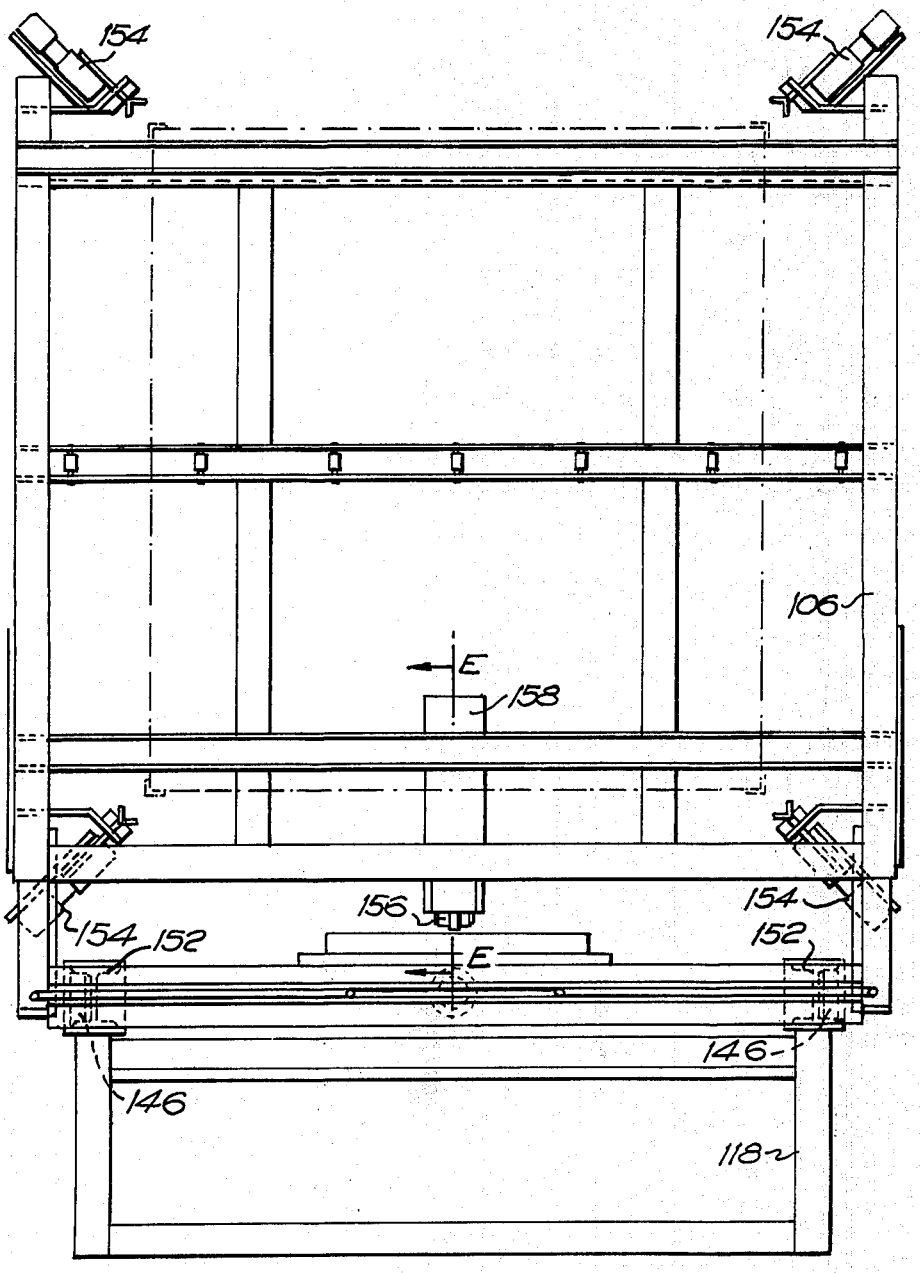

FIGS. 9A, 9B and 9C respectively are detail sectional end views of the ejection means of FIGS. 7 and 8, the sections respectively being taken on lines 9A—9A, 9B—9B and 9C—9C of FIG. 8;

FIG. 9D is a sectional plan of a detail, the section being taken on line 9D—9D of FIG. 9B;

FIG. 10 is a side view of a rack and rack raising means of the apparatus shown in FIGS. 1 and 2;

FIG. 11 is an end elevation of the rack and rack raising means shown in FIG. 10;

FIG. 12 is a plan view of the rack and rack raising means shown in FIGs. 10 and 11;

FIG. 13 is a sectional side view of a detail, the section being taken on line 13—13 of FIG. 12;

FIG. 14 is a sectional side view of a detail, the section being taken on line 14—14 of FIG. 11;

FIG. 15 is a sectional elevation of a detail, the section being taken on line 15—15 of FIG. 11; and FIG. 16 is a sectional elevation of a detail, the section being taken on the line 16—16 of FIG. 10.

Referring to the drawings, and firstly to FIGS. 1 and 2 the apparatus comprises basically a wheel assembly 10 which is mounted for rotating about a horizontal axis 12. The wheel assembly is rotated so that the lower half is located in a tip or well 14 in a supporting structure or the ground 16. The well 14 also accommodates a four tier rack 18 and a rack raising means 20. As can be seen in FIG. 1 the rack 18 and rack raising means 20 are located tangentially to the wheel assembly 10 and to the left hand side thereof. The wheel assembly has means defining four radial chambers 22 (only two being clearly visible in FIG. 1) and such chambers 22 are located at 90° positions of the wheel assembly. Each chamber 22 is adapted to be filled with compost material in which mushrooms are to be grown, such material being fed from a hopper and elevator arrangement 24. The apparatus has a compacting ram means 26 for compacting compost loaded into the chamber 22 which for the time being is located so as to extend vertically upwards from axis 12 and in alignment with ram 26.

Figure 3:
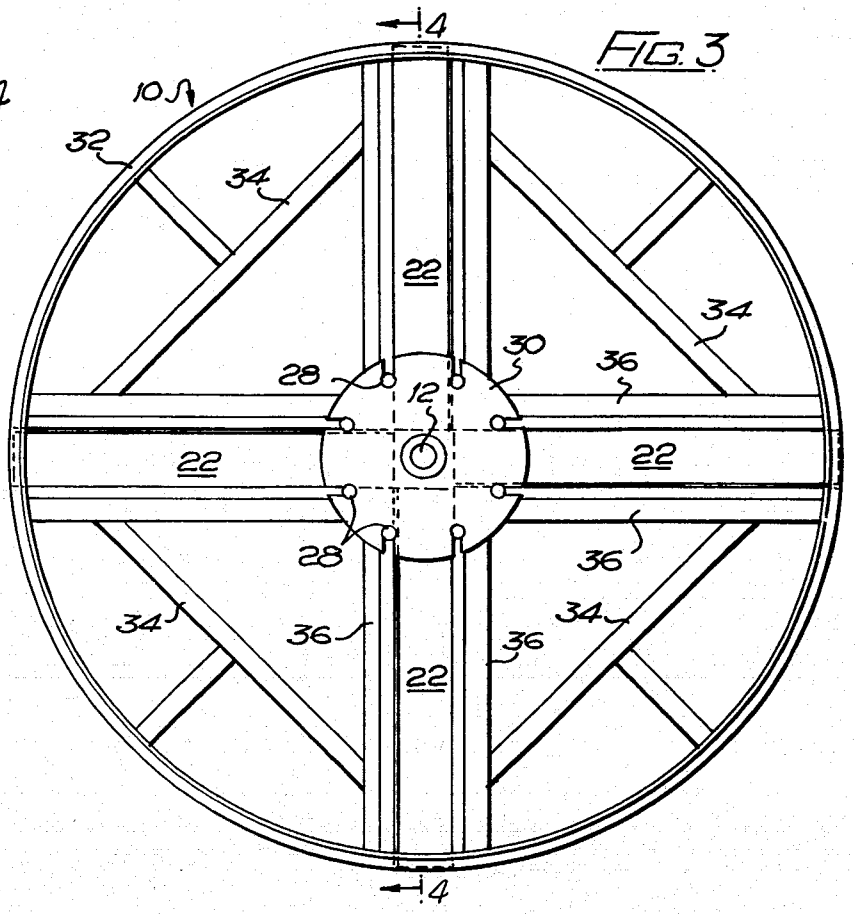
FIG. 3 is a side view of the wheel assembly of the apparatus shown in FIG. 1.
Figure 4:
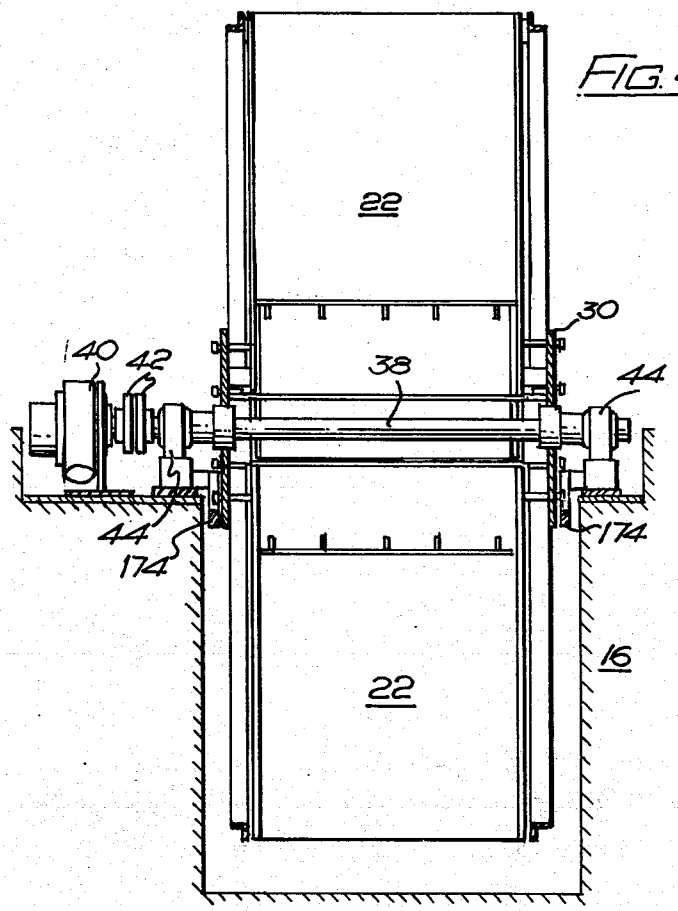
FIG. 4 is a sectional end view of the apparatus shown in FIG. 3, the section being taken on the line 4—4 of FIG. 3.

Referring now to FIGS. 3 and 4, the wheel assembly is shown in these figures in more detail. In FIG. 3, the four chambers 22 are clearly shown, and as will be explained in more detail hereinafter, each chamber is defined by a pair of parallel plate assemblies, the ends of which adjacent the axis 12 are provided with location studs 28 which rotate in disc end plates 30 of which there are two, one located at each side of the wheel assembly 10 so that, at the appropriate time in the cycle of operations, the plates defining a chamber can be moved radially outwards of the wheel assembly 10. Furthermore, in FIGS. 3 and 4, it can be seen that the wheel assembly comprises basically a pair of circular angle iron rails 32 braced by struts 34 and 36. The wheel assembly 10 is carried by a shaft 38 lying on axis 12, and this shaft 38 is adapted to be driven from a hydraulic motor 40 through a coupling 42, the shaft 38 being supported on bearings 44 located outside the wheel assembly and supported by the ground 16.

Figure 5:
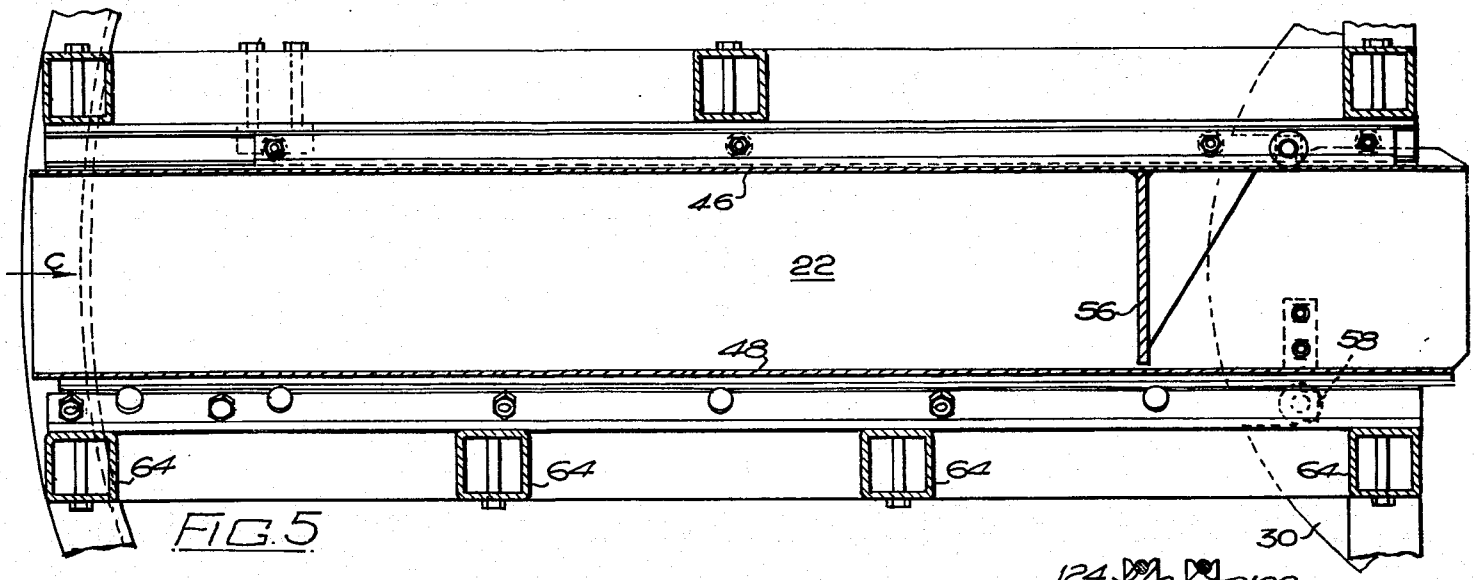
FIG. 5 is an enlarged sectional side view of part of the wheel assembly shown in FIG. 3, the section being taken on the line 5—5 of FIG. 6.
Figure 6:
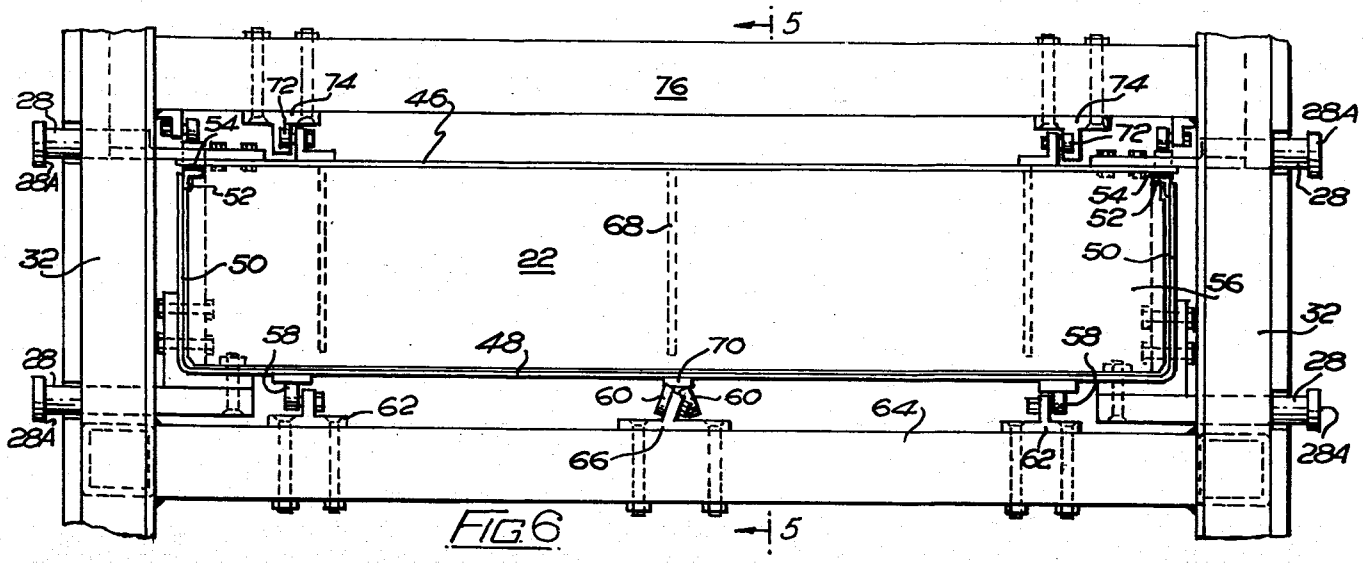
FIG. 6 is an end view of the part of the apparatus shown in FIG. 3, looking in the direction of arrow C in FIG. 5.

Reference is now made to FIGS. 5 and 6, wherein the construction of the means defining a single chamber 22 is shown in detail. It is to be pointed out that the chamber 22 which is illustrated, is the chamber which lies in a horizontal position, and extends from the axis 12 to the region of the rack 18. In fact, in use this chamber would be filled with compacted compost material. The means defining the chamber comprises an upper plate 46 and a lower plate 48, the lower plate 48 as shown in FIG. 6, having side plates 50 extending for the full height of the chamber. The upper plate 46 rests on the side plates 50 through angle bars 52 and friction material 54. Towards the end of plate 46 adjacent the axis 12 there is a rear plate 56, such plate 56 being securely fixed to plate 46, and lying at right angles thereto. As can be seen in FIG. 6 plate 56 is fabricated to the shape of the chamber as defined by lower plate 48, side plates 50 and angle bars 52. The plates 46 and 48 are movable one relative to the other in a radially outward direction relative to axis 12, and to this end plate 48 is supported by a series of rollers in the form of outer rollers 58 and inner rollers 60. The outer rollers 58 are carried on generally radial bars 62 in turn supported on cross bars 64 of the wheel assembly 10, and the centre rollers 60 are located on centre bar 66 lying generally radially of the wheel assembly, and also supported on the bars 64. The rollers 60 are spaced along bar 66, and alternate rollers are located on opposite sides of the centre line 68 of the chamber, the rollers 60 on one side being inclined towards the chamber axis 68, and the rollers 60 on the other side of the centre line 68 being inclined in the opposite direction by the same amount. The rollers 60 bear upon a support strap 70 which has oppositely inclined chamfered surfaces which are engaged by the rollers 60. This ensures that the bottom plate 48 remains central in its outward and inward travel relative to the wheel axis.

The upper plate 46 is suspended by rollers 72 which are engaged in grooves in tracks 74 strapped to the underside of further cross bars 76 of the wheel assembly.

The motion of plates 46 and 48 is such that in use, they are moved radially outwardly in unison to a position overlying a platform of the rack 18, and then in the return movement, the lower plate 48 is retracted first, enabling a block of compost to be placed on the platform surface, and then the top plate 46 is retracted. During the retraction of plate 48, rear plate 56 holds to compost block in the otwardly displaced position.

The means for moving the plates 46 and 48 of each chamber 22 radially outwardly and horizontally at the appropriate time in the cycle of operations, is shown in FIGS. 7, 8, 9A, 9B, 9C and 9D. Such means comprises a pair of U-shaped yokes 78 and 80 which are of identical construction, and yoke 78 is disposed vertically above yoke 80. Each yoke is adapted to be moved by its own ram 82 and 84 respectively. The yokes 78 and 80 are supported on pedestals 86 which are in fact I beams standing on ground 16. If reference is made to FIG. 8, it will be seen that these yokes 78 and 80 lie outside the wheel assembly 10 which is shown in clean dotted lines in FIG. 8, so as not to foul with the rotation of the wheel assembly 10 during operation of the apparatus. At the free end of each limb of yoke 78 and 80 is provided a pad 88 having a cut out 90. This cut out is for the reception of the ends of pins 28 connected to the upper and lower plates 46 and 48, such pins 28 being provided at their ends with disc enlargments 28A (see FIG. 6) which engage in said cut outs 90. The yokes are slidable on guide rails 91 carried by the pedistals 86 in brackets 92, in that slide blocks 94 secured to the limbs of the yokes 78 and 80 slidably engage said guide rails. The arrangement is shown clearly in FIGS. 9A to 9D. When the pair of plates 46 and 48 defining chamber 22 move to the position ready for ejection of the block of soil carried thereby, the disc enlargments 28A are engaged in the cut outs 90, so that extension of rams 82 and 84 causes movement of the yokes 78 and 86 and outward movement of plates 46 and 48.

The remaining figures show the rack 18 and the rack raising means 20. It is to be pointed out that this part of the machine is optional, insofar as it may be desirable to dispense with the specific form of rack and rack raising means now to be described.

In FIG. 10 the rack 18 is shown to have four platforms 98, 100, 102, and 104, these platforms being horizontal and equally spaced in vertical direction. The rack is carried by a cage 106 which, in the course of filling the rack with blocks of compost is raised to the four positions shown at 108, 110, 112 and 114 in chain dotted lines in FIG. 10. The means for raising the cage 106, and hence the rack, comprises a hydraulic ram 116 which is disposed vertically in a supporting framework 118. At its upper end the ram 116 carries a pulley 120 which is a double sheave, as shown in FIG. 14. Two ropes 122 and 124 respectively are trained over the pulleys of sheave 120. These ropes 122 and 124 are symmetrically disposed with respect to the pulley 120, and rope 122 has one end anchored on an axis of fixed pulley 126, such pulley 126 being carried in a mounting 128 carried by a beam 130 of frame 118. From this fixed axis, rope 122 after passing over pulley sheave 120 passes round a pulley 132 symmetrically arranged with respect to pulley 126 and carried by a beam 134 symmetrically arranged with respect to beam 130 and also carried by framework 118. From pulley 132 rope 122 extends vertically upwards and then round to either of pulleys 136 and 138 at the top of framework 118, and then the rope extends downwardly and is fixed to a bracket 140 integral with the cage 106. In a similar manner rope 124 extends from the fixed axis of pulley 132, round pulley 126 over pulleys 142 and 144 at the top of framework 118, and then is fixed to a bracket 140 secured to the outside of the cage 106. Brackets 140 also carry guide rollers 146 whilst lower brackets 148 carry guide rollers 150. Guide rollers 146 and 148 run in vertical channels 152 of the framework 118. Thus, extension of ram 116 raises pulley 120 which has the effect of applying equal pulls on brackets 140 and of raising the cage 106 and the rack carried thereby.

Because of the pulley arrangement, a 2 to 1 velocity ratio is obtained in that for every foot of displacement of pulley 120, the cage 106 is raised by 2 feet.

Cage 106 is provided with four locking cylinders 154 which can be pressurised to move corner pieces into engagement with the corners of the racks in order to hold it in predetermined position relative to the cage, and the cage furthermore is provided with a safety stop roller 156 which is manually operable and which is connected to the ram assembly 158 carried by the cage 106. The ram assembly 158, and its roller 156 are shown in detail in FIG. 13, and it will be seen that the ram assembly 158 is disposed horizontally with the roller 156 directed towards the framework 118. This framework 118 is provided with four equally spaced safety stops 160, 162, 164 and 166. These stops dictate the positions to which the cage 106 is moved during the raising operation if the ram assembly is actuated. When the ram assembly 158 is pressurised, the roller 156 takes up the position shown in chain dotted lines in FIG. 13, in which position it will engage the underside of the next above located stop 160 to 166. When the cage is being raised limit switches control the extent to which raising takes place so as to position the cage 106 and the rack accurately to receive the next block of compost from the wheel assembly.

The apparatus is hydraulically operated as will be appreciated from the preceding description. The hydraulic circuitry and the controls therefor are of conventional construction and therefore are not described in this specification in detail, but referring to FIG. 2, the supply piping for the various components is shown by reference numeral 168 and a lift and transfer mechanism power unit by reference numeral 170 and a unit for operation of ejection rams 82 and 84 by reference 172.

In use of the apparatus, a batch of compost material is placed in the chamber 22 extending vertically upwards from axis 12. The material in this chamber is progressively tamped in conventional manner until it is compacted to the required degree. Upon completion of the tamping the wheel assembly 10 is rotated by 90° to bring the filled chamber 22 to the discharge station (the position shown in FIGS. 5 and 6) by which time the top platform 104 of the rack would be in substantial alignment with the lower plate 48 of the chamber, and the pin enlargements 28 would be located in cut outs 90 of the yokes 78 and 80. Next, the rams 82 and 84 are extended, causing the plates 46 and 48 of the chamber in the discharge position to be moved outwardly and over the platform 104. The bottom ram 84 is now retracted to the initial position, leaving the top plate 46 in the outwardly extended position, and leaving the block of compost on the platform 104. The block of compost must fall slightly as the plate 48 is retracted, and therefore the subsequent retraction of the top plate 46 does not cause any disturbance of the compost black deposited.

During the time that the block is being thus deposited on the platform 104, the operators can be arranging for the next chamber 22 presented in a vertically upwards position from axis 12, to be filled with another batch of material and that batch compacted.

When the top and bottom plates 46 and 48 have been retracted by rams 82 and 84 and the next succeeding chamber filled with compost material, the wheel assembly 10 is indexed by another 90° to bring the newly filled chamber 22 to the discharge station. During this motion the pins 28 of the plates 46 and 48 of one chamber 22 and the pins of the next chamber 22 move respectively out of and into the cut outs 90 in the yokes 78 and 80. The plates 46 and 48 of the chamber 22 moving from the horizontal position to the vertically downwards position, are prevented from dropping out of the wheel assembly by the pins 28 thereof engaging retaining tracks 174 shown in FIG. 4 only.

In this example there are four platforms to be loaded, each with a block of compost material and when one platform has been so loaded, the cage 106 can be raised as explained previously putting the next platform into the exact registered position to receive the block of compost from the next full chamber 22 presented to the discharge station, and the cycle is repeated.

The rack may be arranged to be movable out of the cage on rollers or the like provided on the bottom of the cage or on the bottom of the rack or both. In fact, in FIG. 2 there is shown an output track 176 on to which the filled rack can be moved and on which the filled rack can freely run, and a similar input track 178 by which empty racks can be moved into the cage.

The apparatus at present envisaged uses a hydraulic system of motive power and is partly automatic in operation. The filling of the chambers, the tamping of the compost, the raising of the rack frame and the initiation of each new index of 90° is under the direct control of the operator.

It is appreciated however, that any suitable power means can be used to drive the apparatus, and it can be arranged to operate fully automatically or fully manually as desired depending upon the appliciation. As regards application, it is to be pointed out that the apparatus can be used for the handling of compacted blocks of material other than soil and compost.

It will be noticed that in the embodiment of the invention described, the platforms are not placed in vertical disposition as is done in the conventional method. Moreover, the chambers can be made robust so as to withstand the tamping pressure and will tend to yield blocks of predetermined shape repeatedly which makes growing results more predictable. The adoption of plates which are independently movable enables the depositing of the blocks with minimum disturbance and the platforms themselves do not experience any of the tamping pressure and therefore should be usable much longer or indefinitely.

Even and regular blocks of compact material are produced and deposited by the apparatus and this provides another advantage that the picking of mushrooms grown in the compacted blocks and the dressing of the top of the blocks which is sometimes required during cultivation of mushrooms are simplified.

We claim:

1. Apparatus for the handling of blocks of compacted soil compost or the like, comprising:

a. chamber means adapted to be held at a receiving station to receive a batch of soil, compost or the like;

b. means for compacting the material within said chamber means at said receiving station;

c. first means for moving said chamber means to a discharge station;

d. a platform at said discharge station, e. second means for moving said chamber means, while at said discharge station, over said platform;

f. means for retracting said chamber means from said platform; and g. means operative upon retraction of said chamber means for discharging a compacted block of compost, soil or the like upon said platform.

2. The invention according to claim 1 further comprising a plurality of said chamber means adapted to be moved in an endless path through said receiving station and said discharge station, said first and second moving means and said retraction means sequentially operating each chamber means at said discharge station.

3. The invention according to claim 2 further comprising a wheel assembly rotatable about a horizontal axis, four said chamber means mounted on said wheel assembly at 90° intervals around the periphery thereof, said chamber means extending radially relative to said wheel assembly.

4. The invention according to claim 3 in which each said chamber means comprises parallel top and bottom plates, said plates lying horizontally at said discharge station.

5. The invention according to claim 4 in which said top and bottom plates are movable independently of each other horizontally at said discharge station.

6. The invention according to claim 5 further comprising a pusher plate depending from said top plate spaced closer to the rotary axis of said wheel assembly than the periphery of said wheel assembly and defining an end wall of said chamber means, said lower plate having opposed side plates defining the side walls of said chamber means.

7. The invention according to claim 5 further comprising guide rollers supporting said top and bottom plates for independent movement radially of said wheel assembly.

8. The invention according to claim 4 in which said means for moving said top and bottom plates includes a pair of independently movable and horizontally disposed U-shaped yokes having arms spaced on opposite sides of said wheel assembly, ram means for reciprocably moving said yokes, means on said yoke arms for detachably engaging corresponding top and bottom plates for horizontal movement when said top and bottom plates are in said discharge position.

9. The invention according to claim 8 in which said ram means are operable to reciprocate said yokes radially of said wheel assembly at said discharge station, and include first means for retracting said lower plate to said discharge station from said platform and second means for retracting said top plate to said discharge station from said platform after the retraction of said bottom plate, and means for rotating said wheel assembly to move the next following chamber means into said discharge station.

10. The invention according to claim 1 further comprising a rack having a plurality of horizontal, vertically spaced platforms, said rack being positioned so that said platforms can receive blocks of compacted material from each of said chamber means in said discharge station, and means for raising said rack to sequentially present platforms in registry with said discharge station.

11. The invention according to claim 10 in which said means for raising said rack comprises a cage supporting said rack, and elevator ram means for raising and lowering said cage.

12. The invention according to claim 11 in which said elevator ram means is operatively connected to said cage by a cable and pulley device having a velocity ratio in which said cage is moved twice the distance of said elevator ram means.

13. The invention according to claim 11 further comprising vertically spaced stops adjacent said cage, and an abutment roller on said cage for sequentially engaging said stops to locate said platform at different elevations.

14. The invention according to claim 11 further comprising releasable location and holding means on said cage for holding a rack in a predetermined position relative to said cage, said releasable location and holding means being releasable so said rack can be moved horizontally of said cage.

* * * * *